US009822539B1

(12) United States Patent
Krombein

(10) Patent No.: US 9,822,539 B1
(45) Date of Patent: Nov. 21, 2017

(54) HIGH FLOW INTERCHANGEABLE DRAIN COVER ASSEMBLY

(71) Applicant: Todd Krombein, Phoenix, AZ (US)

(72) Inventor: Todd Krombein, Phoenix, AZ (US)

( * ) Notice: Subject to any disclaimer, the term of this patent is extended or adjusted under 35 U.S.C. 154(b) by 33 days.

(21) Appl. No.: 14/993,005

(22) Filed: Jan. 11, 2016

Related U.S. Application Data

(60) Provisional application No. 62/101,970, filed on Jan. 9, 2015.

(51) Int. Cl.
*E04H 4/12* (2006.01)
*E03F 5/04* (2006.01)

(52) U.S. Cl.
CPC ..... *E04H 4/1236* (2013.01); *E03F 5/0408* (2013.01)

(58) Field of Classification Search
CPC ..... E04H 4/1236; E03F 5/0408; E03C 1/22; E03C 1/26
USPC .... 210/163, 164, 167.1, 167.16; 4/292, 490, 4/496, 507, 613, 679
See application file for complete search history.

(56) References Cited

U.S. PATENT DOCUMENTS

| | | | | |
|---|---|---|---|---|
| 6,209,586 | B1 * | 4/2001 | Wright | E04H 4/1236 4/507 |
| 8,833,387 | B2 * | 9/2014 | Lucas | E03F 5/0407 4/613 |
| 2007/0180605 | A1 * | 8/2007 | Griffin | E04H 4/1236 4/507 |
| 2008/0098506 | A1 * | 5/2008 | Mjelde | E04H 4/1218 4/507 |
| 2008/0148474 | A1 * | 6/2008 | Witt | E03F 5/0408 4/613 |
| 2012/0023658 | A1 * | 2/2012 | Bobeck | E03F 5/0408 4/679 |
| 2012/0036631 | A1 * | 2/2012 | Cook | E03F 5/0408 4/679 |
| 2013/0061387 | A1 * | 3/2013 | Stetson | E03F 5/0408 4/613 |

* cited by examiner

*Primary Examiner* — Christopher Upton
(74) *Attorney, Agent, or Firm* — Knobbe Martens Olson & Bear LLP

(57) ABSTRACT

A high flow drain cover assembly for a water feature is provided herein. The drain cover assembly can be interchangeably used as an open flow system or as a grated flow system. The drain cover assembly has a concave upper sump cover adapted to seat a surface finish so that the visual appearance of the drain cover assembly matches the surround surface into which the drain cover assembly is installed. The base of the drain cover assembly is shaped to reinforce the cover and define flow paths that allow flow rates of over 300 gallons per minute to pass through the drain cover assembly.

24 Claims, 15 Drawing Sheets

HIGH FLOW INTERCHANGEABLE DRAIN COVER ASSEMBLY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field of the Invention

Certain embodiments discussed herein relate to drain cover assemblies for swimming pools, spas, and other water features.

Description of the Related Art

Drains are typically installed in the bottom of a water feature (e.g., pool, spa) for water removal and circulation purposes. For example, drains can be a component of cleaning systems that are used to clean the water of a water feature. Cleaning systems can remove water from the water feature through a drain, clean the water, and then return the water to the water feature. It is desirable for the drain to support large flow rates and sufficient suction so that water and debris can be removed more quickly from the water feature. However, due to the strong suction created by drains, it is important for drains installed in swimming pools and spas to be protected by drain covers that inhibit suction entrapment of swimmers while at the same time provide high flow rate and preserve the aesthetic appeal of the water feature.

SUMMARY

The systems, methods and devices described herein have innovative aspects, no single one of which is indispensable or solely responsible for their desirable attributes. Without limiting the scope of the claims, some of the advantageous features will now be summarized.

In some embodiments, an interchangeable high flow drain cover assembly is provided. The drain cover assembly can be interchangeably used as an open flow system or as a grated system. The flow rates and suction force can be adjusted in accordance with requirements of the system. The drain cover assembly comprises a sump base having a substantially circular sidewall defining an upper opening and a lower opening. The sump base can have an upper sump base portion and a lower sump base portion. The lower sump portion comprises a flow disbursement reservoir. The sidewall of the upper sump base portion is sloped to facilitate water flow, and the sidewall of the flow disbursement reservoir has a reduced slope as compared to the slope of the upper sump base portion. The drain assembly further includes a sump cover, wherein sump cover has an upper concave surface and a concave configuration sized to fit over the sump base. In some implementations, the sump cover configured to nest inside the upper sump base portion. The drain cover assembly further includes an annular opening disposed between the sump base and sump cover, which is configured to allow water to flow therethrough to the sump base and out the lower opening of the sump. The upper concave surface of the sump cover is configured to seat a plaster-like surface finishing material in a manner such that the supper surface of the plaster-like surface finishing material is flush with the annular opening.

In some configurations, a drain cover assembly has a sump cover that is circumferentially surrounded by a sump base. The sump cover has posts extending from the front surface of the sump cover. The posts are axially aligned with and supported by columns extending from the top surface of the sump base. The top surface of the sump base is in fluid communication with an outflow portion.

In some configurations, a central portion of the top surface of the sump base is recessed with respect to a peripheral portion of the sump base.

In some configurations, the peripheral portion of the sump base has a first radius and the central portion has a second radius, with a ratio of the first radius to the second radius being about 1.6.

In some configurations, a part of the peripheral portion of the top surface has a radius of curvature and is separated from the sump cover surface by a height, with the ratio of the radius of curvature to the height being about 0.3.

In some configurations, the drain cover assembly has a flow diffuser interposed between the post and the column.

In some configurations, the front surface of the sump cover includes a feature that is adapted to secure a facing material to the sump cover.

In some configurations, the sump cover includes ribbing for securing a facing material to the sump cover.

In some configurations, the front surface of the sump cover is concave.

In some configurations, the sump cover has a radius and a depth, wherein a ratio of the depth to the radius is about 0.05.

In some configurations, the drain cover assembly includes a facing material that is selected from the group consisting of: plaster, aggregate, tile, plastic, and epoxy.

In some configurations, the sump cover further comprises a reversible insert.

In some configurations, a surface of the reversible insert includes a feature for securing a facing material to the surface.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1:
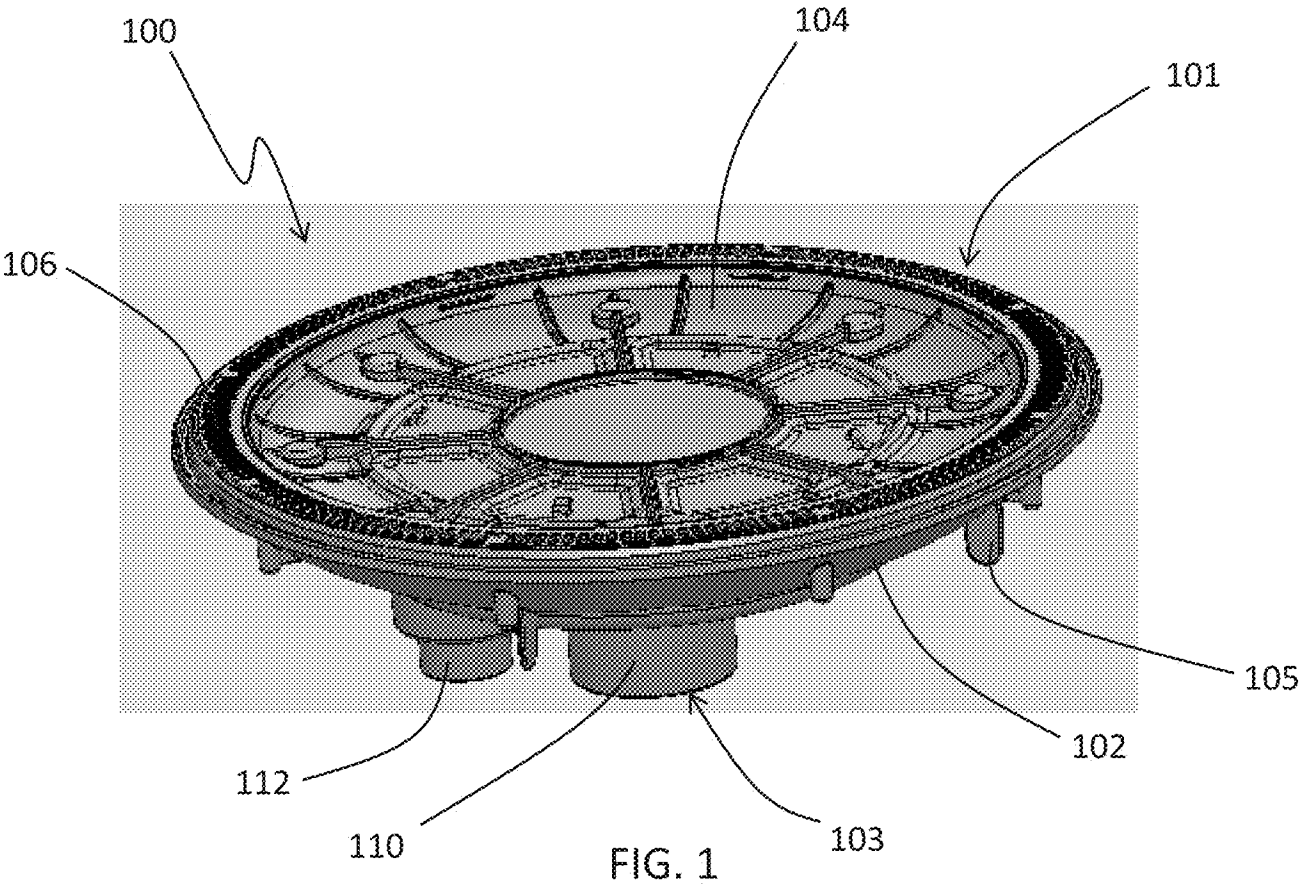
FIG. 1 is a perspective view of an embodiment of a drain cover assembly.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

FIG. 1 depicts a non-limiting, illustrative embodiment of a high flow interchangeable drain cover assembly 100. The drain cover assembly 100 can include a sump base 102, a sump cover 104, and a drain opening 105. As discussed in greater detail below, the drain cover assembly 100 can be interchangeably used as both an open flow system and a grated flow system. In the open flow system, the drain opening 105 has an annular configuration that circumscribes the outer perimeter of the sump cover 104. In the grated system, an annular drain grate 106 is configured to detachably couple to the drain opening 105. The drain cover assembly 100 can have an outflow portion 110 that is adapted to connect the drain cover assembly 100 to a pipe (not shown). In some variants, the drain cover assembly 100 can include a relief port 112 for connecting the drain cover assembly to a hydrostatic relief valve (not shown). The sump base 102 can comprise one or more rebar anchors 105 for securing the drain cover assembly 100 to a surrounding material (e.g., concrete).

The drain cover assembly 100 has a top 101, which faces toward the volume of water that is being drained by the drain cover assembly 100. The drain cover assembly 100 has a bottom 103, which faces away from the top 101. In the illustrative embodiment, the drain grate 106 lies at the top 101 of the drain cover assembly 100. Under normal operating conditions, water flows into the drain cover assembly 100 at the top 101 and flows out of the drain assembly 100 at the outflow portion 110. However, water can flow into the drain cover assembly 100 at the relief port 112 and out of the drain cover assembly 100 at the top 101 or through the outflow portion 110 when the hydrostatic relief valve is active. The hydrostatic relief flow path is not the normal operation of the drain cover assembly 100. The high flow drain cover assembly 100 of the present disclosure can support high rates of flow (e.g., over 300 gallons per minute) when the direction of flow through the drain cover assembly 100 is from the top 101 to the outflow portion 110.

The drain cover assembly 100 can be installed into a surrounding surface (e.g., the bottom of a swimming pool). The top 101 of the drain cover assembly 100 can be visible when the drain cover assembly 100 is installed into a surrounding surface. As discussed in detail below, the drain cover assembly 100 can include features that allow the top 101 of the drain cover assembly 100 to blend in with the surrounding surface into which the drain cover assembly 100 is mounted, thereby making the drain cover assembly 100 less disruptive to the aesthetic appeal of the surrounding surface.

Figure 2:
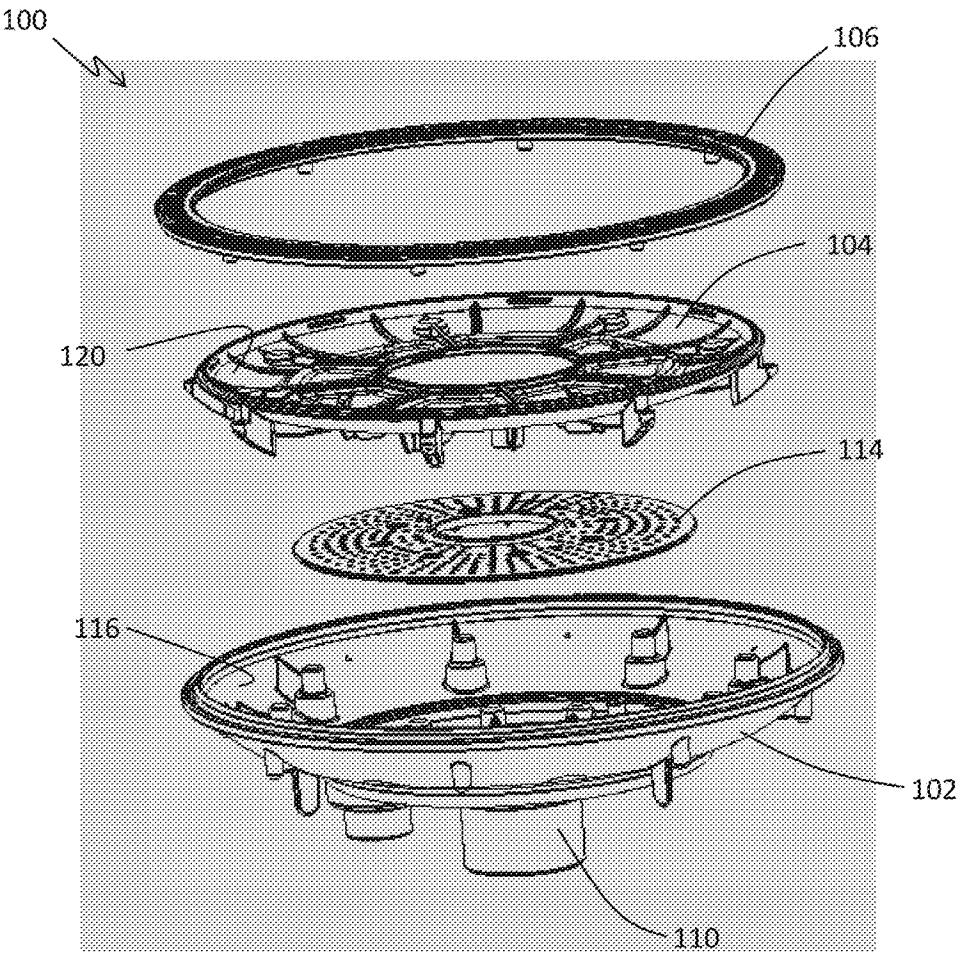
FIG. 2 is an exploded view of the embodiment of FIG. 1.

Referring to FIG. 2, the drain cover assembly 100 can include a flow diffuser 114 that is interposed between the sump base 102 and the sump cover 104. The sump base 102 can have a top surface 116 that faces away from the outflow portion 110 and can be generally concave in form, as shown in FIG. 2. The sump cover 104 can have a top surface 120 that faces away from the sump base 102 and can be generally concave in form. In some variants, the concavity of the top surface 120 of the sump cover 104 can be less pronounced than the concavity of the top surface 116 of the sump base 102. The sump base 102 and the sump cover 104 can be adapted so that the sump cover 104 can nest inside the sump base 102. For example, in the illustrated embodiment, the sump base 102 and the sump cover 104 are generally circular, with the inner surface 116 of the sump base 102 being sufficiently large to receive and circumferentially surround the sump cover 104. In some variants, the shape of the drain assembly 100 can be a shape other than circular (e.g., oval, elliptical, polygonal).

As discussed above, the drain cover assembly 100 can include the drain grate 106 through which the water passes to enter the drain cover assembly 100. In the illustrated embodiment, the drain grate 106 is a ring-like structure that circumferentially surrounds the sump cover 104 and couples with the drain cover assembly. However, the drain grate 106 need not circumferentially surround the sump cover 104. In some variants, the drain assembly 100 can include one or more drain grates 106 that only partially surround the drain cover 104.

Figure 3B:
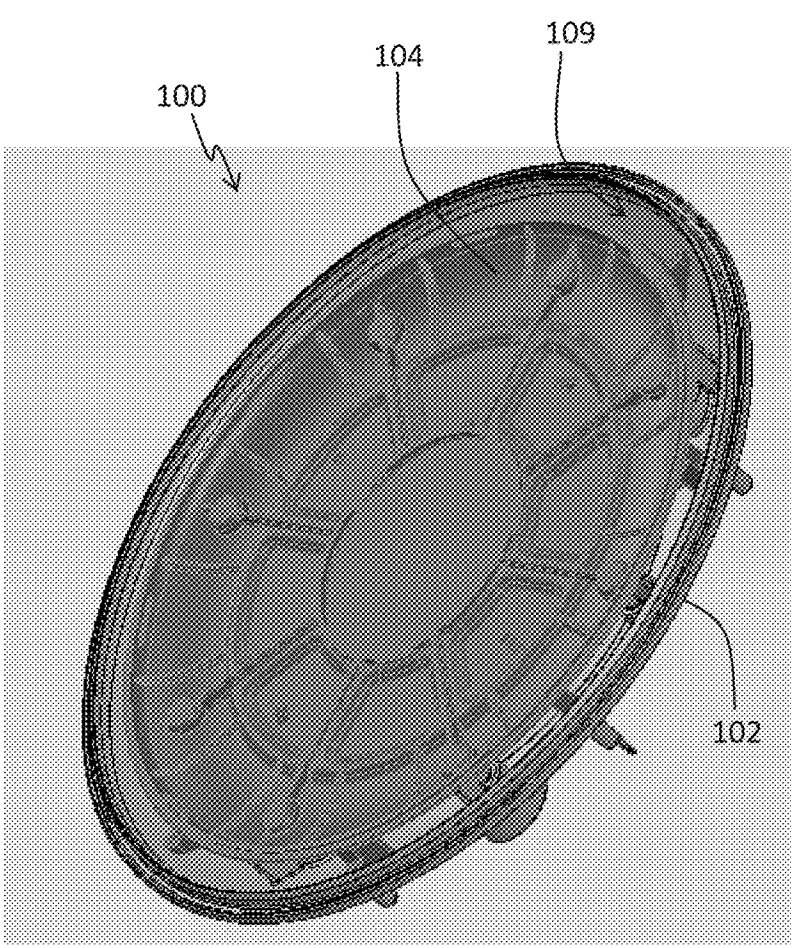
FIG. 3B is an embodiment of a drain cover assembly that is configured as an open flow system.
Figure 3A:
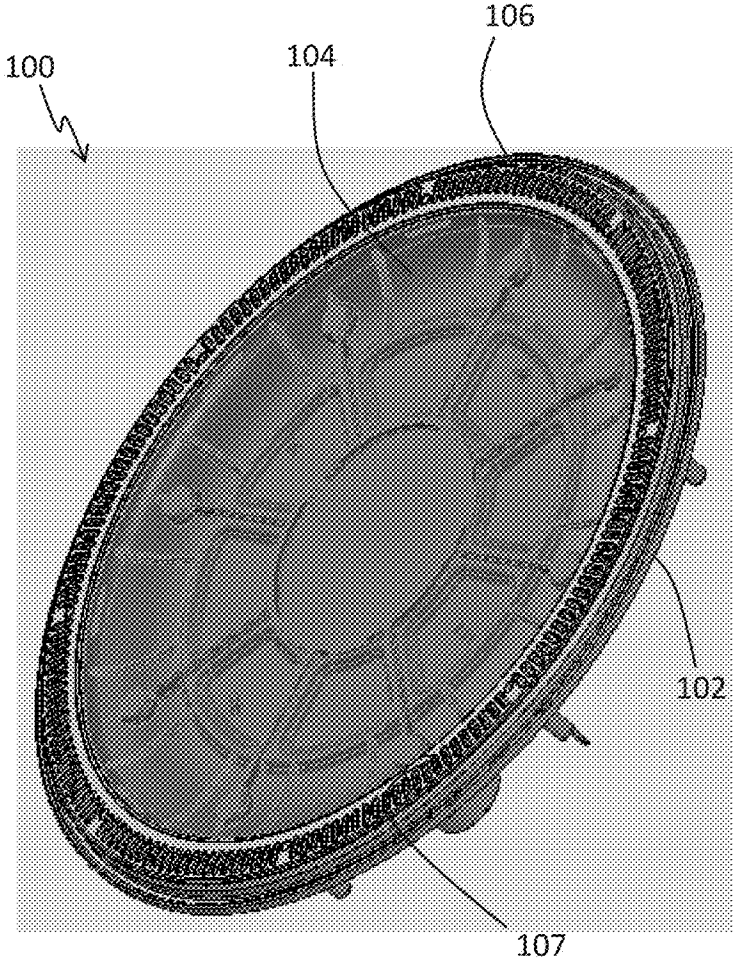
FIG. 3A is an embodiment of a drain cover assembly that is configured as a grated flow system.

Referring to FIGS. 3A and 3B, the drain grate 106 can be removable, allowing the drain cover assembly 100 to be used interchangeably used as a grated (FIG. 3A) or open (FIG. 3B) flow system. In one implementation, the drain grate can be removably attached to spaced apart anchors formed along the lip of the upper sump base. The drain grate 106 depicted in FIG. 3A has a plurality of openings 107 through which the water flows to enter the drain cover assembly 100. The openings 107 in the illustrative embodiment are similar to one another and radiate away from the center of the ring-like structure of the drain grate 106. However, the openings 107 of the drain grate 106 can take other forms. For example, the openings 107 of the drain grate 106 can differ from one another in shape and/or in cross-sectional area. The openings 107 need not be arranged in a radiating configuration. In some embodiments, the drain grate 106 can include features that disrupt the formation of a vortex over the drain cover assembly 100. For example, the drain gate 106 can include cupped protrusions (not shown) that extend above the openings 107 and guide the water into the openings 107 from a particular direction. The cupped protrusions can be arranged so that a portion of the water entering the drain cover assembly 100 enters along a first rotational direction (e.g., clockwise) and a portion of the water entering the drain cover assembly 100 enters along an opposite rotational direction (e.g., counter-clockwise), thereby frustrating the formation of a vortex.

FIG. 3B depicts an embodiment of the drain cover assembly 100 that is configured as an open flow system. The flow can enter the drain cover assembly 100 through a gap 109 that circumferentially surrounds the sump cover 104. In some variants, the drain cover assembly 100 can include one or more gaps 109 that only partially circumferentially surround the sump cover 104. In the illustrative embodiments, the sump cover 104 is radially inward of the gap 109 and the water enters the drain cover assembly 100 along a line that is substantially perpendicular to the top of the drain cover assembly 100.

In some variants, at least a portion of the sump cover 104 can be above the gap 109 and extend radially beyond the gap 109. In this way, the sump cover 104 can be configured to obscure the gap 109 when the drain cover assembly 100 is viewed from the top. This configuration of the sump cover 104 can enhance the ability of the drain cover assembly 100 to blend in with the surrounding material into which the drain cover assembly 100 is installed, as described below. When the sump cover 104 extends radially beyond the gap 109, water can flow laterally into the drain cover assembly 100 through the space between the sump cover 104 and the sump base 102. In other words, the water can enter the drain cover assembly 100 along a line that is substantially parallel to the top of the drain cover assembly 100. In the variant where the sump cover 104 extends radially over the gap 109, the drain cover assembly 100 can include a vertical grate (not shown) that is interposed between the sump cover 104 and the sump base 102. For example, the grate can include a plurality of vertical bars through which the water flows to enter the drain cover assembly 100 along a line substantially parallel to the top of the drain cover assembly 100. In other words, the aforementioned embodiments illustrate that the drain cover assembly 100 can be configured for open or grated flow systems with the water entering the drain cover assembly 100 along a line that is parallel to the sump cover 104 or along a line that is perpendicular to the sump cover 104.

Figure 3C:
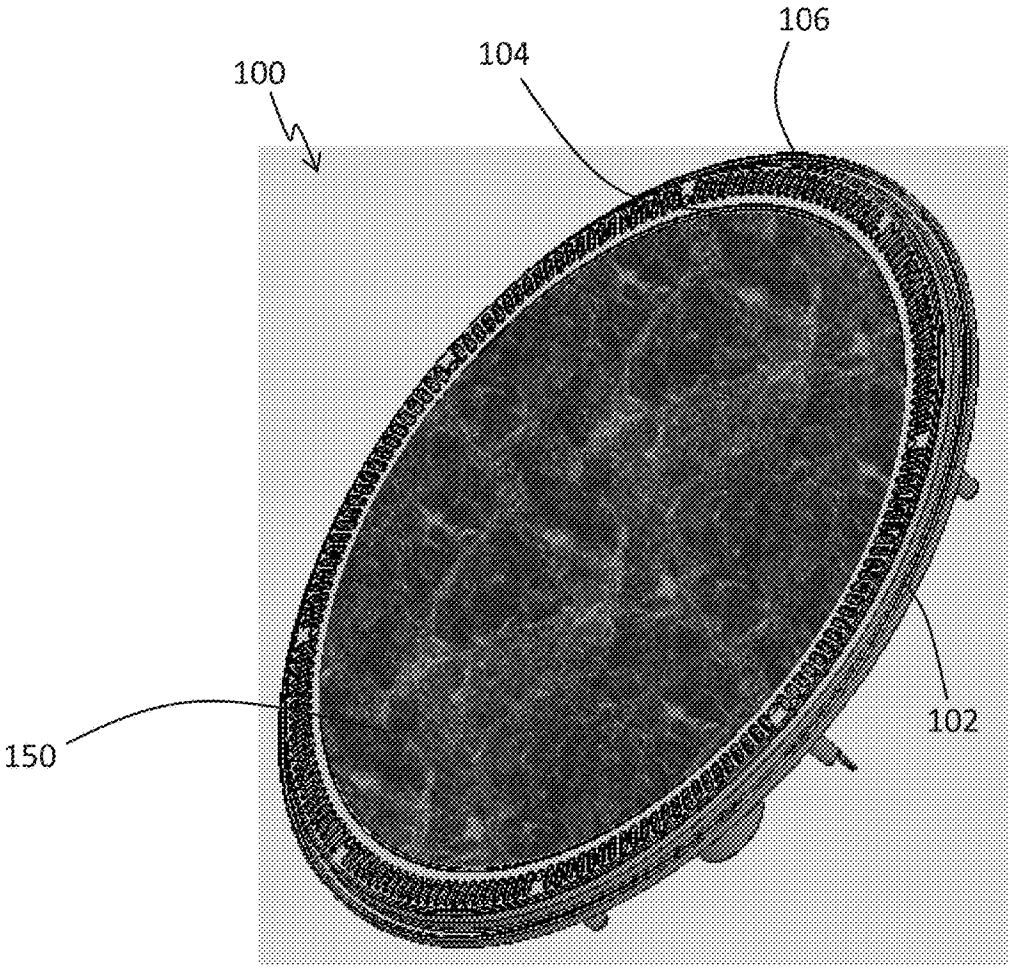
FIG. 3C is an embodiment of a drain cover assembly having a facing material secured to the drain cover assembly.

FIG. 3C depicts an embodiment of the drain cover assembly 100 having a facing material 150 attached to the sump cover 104. The shown embodiment has a grate 106 that circumferentially surrounds and is substantially co-planar with the sump cover 104. In some variants, the drain cover assembly 100 can be an open flow system that includes the facing material 150 attached to the sump cover 104 and the sump cover 104 can extend radially beyond the gap through which water enters the drain cover assembly 100, as discussed above.

The facing material 150 can be selected to match the appearance of the surrounding material into which the drain cover assembly 100 is installed. The facing material 150 can be a plaster-like material that is applied to the sump cover 104 and then allowed to harden. The facing material 150 can be a deformable insert that is snap-fitted onto the sump cover 104. The facing material 150 can be a tile-like material that is installed onto grout that has been applied to the sump cover 104.

Figure 4B:
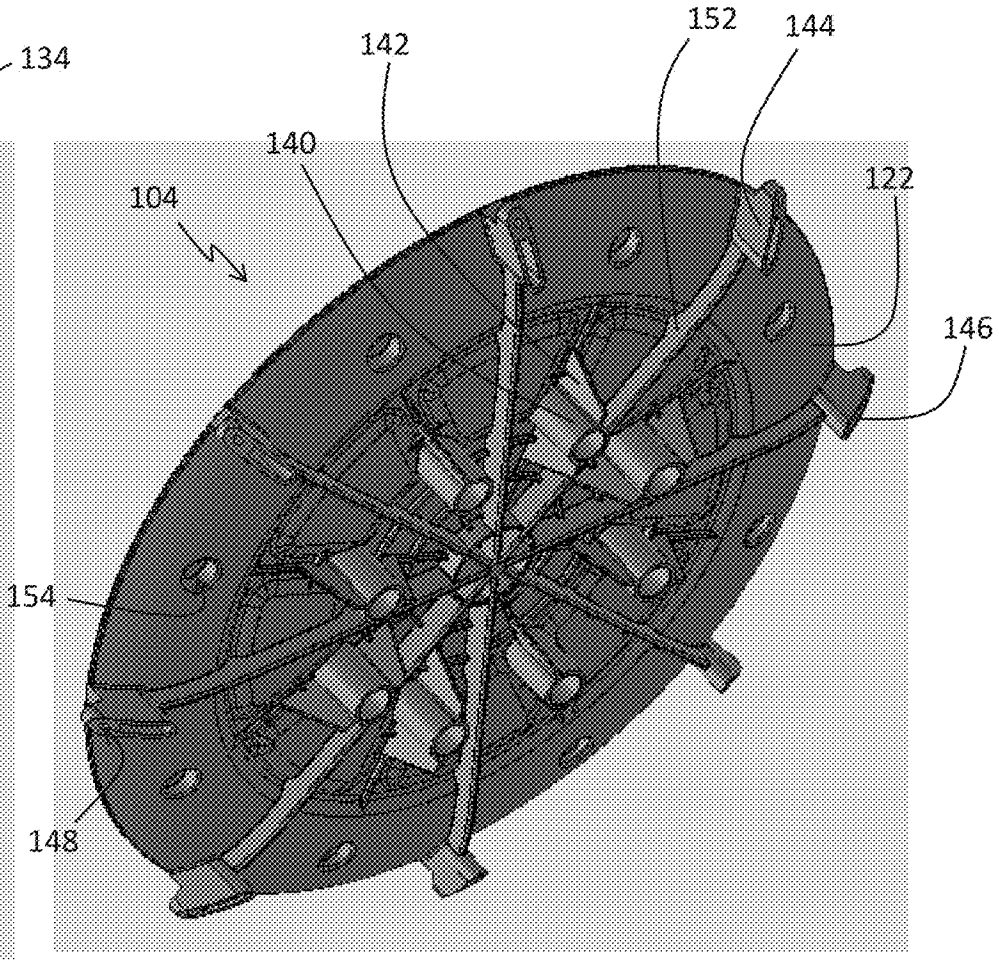
FIG. 4B is a partial back view of the embodiment of FIG. 4A.
Figure 4A:
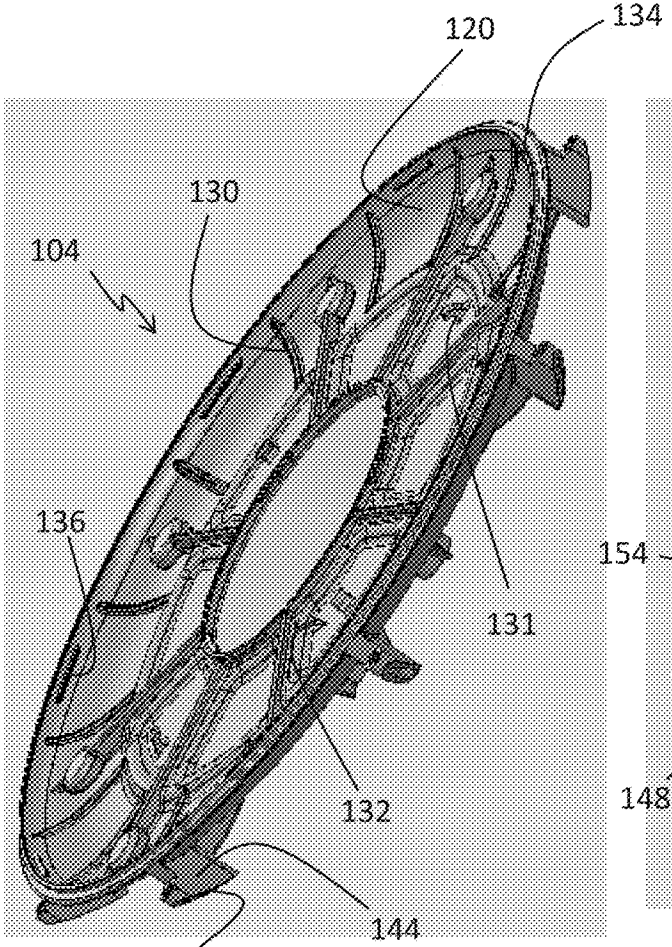
FIG. 4A is a partial front view of an embodiment of a sump cover.

FIGS. 4A and 4B depict an illustrative embodiment of the sump cover 104. The top surface 120 of the sump cover 104 can be adapted to accept and retain the facing material 150 (shown in FIG. 3C). The facing material 150 can be selected to blend in with the surrounding material into which the drain cover assembly 100 is installed. The facing material 150 can be plaster, aggregate, tile, epoxy, or conventional plastic. In some variants, the sump cover 104 can include a plurality of ribbing 130 that provides bonding surfaces for the facing material 150. For example, the ribbing 130 can have the form of an "I" beam, thereby allowing a plaster-like facing material to flow around the ribbing 130 and be retained by the ribbing 130 after the plaster-like facing material hardens. The ribbing 130 can include one or more hook-like protrusions 131 that provide a bonding surface for the facing material 150.

The ribbing 130 can define compartments 132 that help retain the facing material 150 after the facing material 150 has hardened. For example, the ribbing 130 can surround the perimeter of a compartment 132, with the top portion of the ribbing being angled toward the interior of the compartment 132, thereby creating a compartment 132 with a tapered volume. Because the ribbing 130 defining the compartment 132 is angled toward the interior of the compartment 132, the base of the compartment 132 (which is disposed at the top surface 120 of the sump cover 104) will have a larger cross-sectional area than the top of the compartment 132. Accordingly, after a plaster-like facing material is pressed into the compartment 132 and allowed to harden, the base portion of the hardened plaster-like facing material cannot exit through the smaller cross-sectional area of the top of the compartment 132. In this way, the tapered compartment 132 retains the facing material on the top surface 120 of the sump cover 104.

The sump cover 104 can include a lip 134 that curves radially inward, as illustrated in FIG. 4A. The lip 134 can provide a surface that retains the facing material on the sump cover 104. For example, the facing material can be a plaster-like material that cannot pass by the lip 134 after the plaster-like facing material has hardened, as described above for the compartments 132 with angled ribs 130. In some variants, the facing material 150 can be an insert that can be snap-fitted onto the sump cover 104 by deforming the lip 134. The snap-fitted insert can be made of conventional plastic or other suitable material. The sump cover 104 can include one or more water stops 136 that prevent water from leaking under the facing material installed on the sump cover 104.

As shown in FIG. 2, the sump base 102 can have a bowl-like form and the sump cover 104 can have a shallower bowl-like form. The sump cover 104 can sit at least partially inside the sump base 102. The high flow drain cover assembly 100 can generate a suction force that tends to pull the sump cover 104 toward the sump base 102. Water flowing through the drain cover assembly 100 can flow through the space created between the sump cover 104 and sump base 102, as described below. If the suction force of the drain cover assembly 100 pulls the sump cover 104 toward the sump base 102, the space between the sump cover 104 and the sump base 102 can become reduced, thereby compromising the high flow rate through the drain cover assembly 100. Also, deformation of the sump cover 104 toward the sump base 102 may cause the facing material 150 to crack or become dislodged from the sump cover 104. Accordingly, the sump cover 104 and the sump base 102 can be configured to minimize deformation of the sump cover 104 toward the sump base 102.

Referring to FIG. 4B, the sump cover 104 can include features that increase the rigidity of the sump cover 104, thereby reducing the deformation of the sump cover 104 due to the suction force of the drain cover assembly 100. The sump cover 104 can include one or more posts 140 that extend from a back surface 122 of the sump cover 104. The post 140 can be a substantially cylindrical, tube-like structure. The post 140 can include one or more flanges 142 that extend from the side surface of the post 140. The flange 142 can taper as the flange 142 extends away from the bottom surface 122 of the sump cover 104. In some variants, the flange 142 can be aligned along the radial direction of the sump cover 104, as illustrated in FIG. 4B. However, the flange 142 can be aligned in a direction other than the radial direction. In some embodiments, the flange 142 can be curved. The flanges 142 can be oriented to frustrate the formation of a vortex over the drain cover assembly 100. For example, some flanges 142 can be curved to impart a slight clock-wise momentum to the water flowing toward the outflow portion 110 of the drain cover assembly 100, while other flanges 142 can be curved to impart a slight counter-clockwise momentum to the water passing through the drain cover assembly 100.

In the illustrative embodiment, the posts 140 are disposed on the sump cover 104 about half-way between the center and the edge of the sump cover 104. The posts 140 can be arranged around the center of the sump cover 104 at approximately the same distance from the center of the sump cover 104 and may be spaced about equally apart from each adjacent post 140. However, the posts 140 can be placed in various other configurations. For example, the posts 140 can be positioned at different radial distances from the center of the sump cover 104. The posts 140 can be unevenly distributed circumferentially around the center of the sump cover 104. The posts 140 can be solid and/or can have a form other than cylindrical. The post 140 can taper toward or away from the bottom surface 122 of the sump cover 104.

The sump cover 104 can include one or more spacers 144 that extend from the back surface 122 of the sump cover 104. The spacers 144 can reinforce the periphery of the sump cover 104. The spacers 144 can be a substantially plate-like structure, as shown in FIG. 4B. The spacers 144 can include a curved surface 146 that rests on the top surface 116 of the sump base 102. The curved surface 146 can be configured to match the curvature of the top surface 116 of the sump base 102 (shown in FIG. 2) so that the curved surface 146 is substantially flush with the top surface 116 when the sump cover 104 is mounted onto the sump base 102. The spacer 144 can include a through hole 148 through which a fastener (e.g. screw) can pass to secure the sump cover 104 to the sump base 102.

In the illustrative embodiment, the spacers 144 are disposed on the sump cover 104 at the outer edge of the sump cover 104. In some variants, the spacers 144 are disposed inward of the outer edge of the sump cover 104. The spacers 144 can be arranged around the center of the sump cover 104 at approximately the same distance from the center of the sump cover 104 and may be spaced about equally apart from each adjacent spacer 144. However, the spacers 144 can be placed in various other configurations. For example, the spacers 144 can be positioned at different radial distances from the center of the sump cover 104. The spacers 144 can be unevenly distributed circumferentially around the center of the sump cover 104. The spacers 144 can be solid or hollow and can have a form other than plate-like (e.g., cylindrical). The spacers 144 can be oriented to frustrate the formation of a vortex over the drain cover assembly. For example, some spacers 144 can be angled away from the center of the sump cover 104 in such a way as to impart a slight clockwise momentum to water flowing through the drain cover assembly, while other spacers 144 can be angled to impart a slight counter-clockwise momentum to the water passing through the drain cover assembly 100.

Referring to FIG. 4B, the sump cover 104 can include one or more spines 152 that extend from the back surface 122 of the sump cover 104. The spines 152 can reinforce the sump cover 104. The spines 152 can be a substantially plate-like in structure, as shown in FIG. 4B. However, the spines 152 can have other forms such as partially cylindrical, with the longitudinal axis of the spine 152 being aligned with the plane of the sump cover 104. In the illustrative embodiment, the spines 152 are substantially linear, aligned in the radial direction of the sump cover 104, and equally spaced from adjacent spines 152. In some variants, the spines 152 can be non-linear (e.g., arcuate, undulating, sinusoidal), aligned in a direction other than the radial direction of the sump cover 104, or unevenly spaced apart from adjacent spines 152.

In the shown embodiment, the spines 152 are coupled to the spacers 144. In some variants, some, all, or none of the spines 152 are connected to a spacer 144. In the illustrative embodiment, the spines 152 have a similar appearance to one another. In some variants, one or more spines 152 can have different widths and/or different thicknesses from other spines 152. The width or thickness of a spine 152 can vary along the length of the spine 152. In the illustrative embodiment, the spines 152 are arranged in a hub-and-spoke configuration with a single hub spine disposed near the center of the sump cover 104. In some embodiments, the sump cover 104 can include none, one, or more than one hub spines 152 that circumferentially surround the center point of the sump cover 104.

The sump cover 104 can include one or more counter-sinks 154. As discussed below, the counter-sinks 154 can be configured to receive a portion of the sump base 102. In the illustrative embodiment, the counter-sinks 154 are circumferentially spaced about the periphery of the sump cover 104 and are about mid-way between adjacent spacers 144. In some variants, one or more counter-sinks 154 can be at a different radial distance from the center of the sump cover 104 than are other counter-sinks 154. The counter-sinks 154 can be unevenly spaced circumferentially from adjacent counter-sinks 154.

Figure 5B:
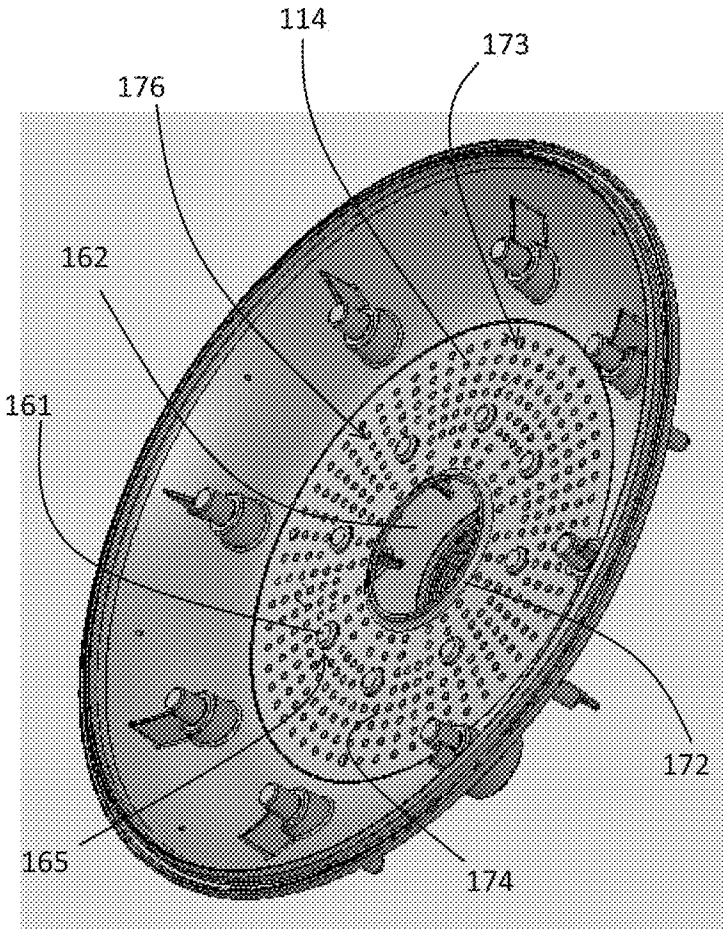
FIG. 5B is a partial front view of the embodiment of the sump base with a flow diffuser.
Figure 5A:
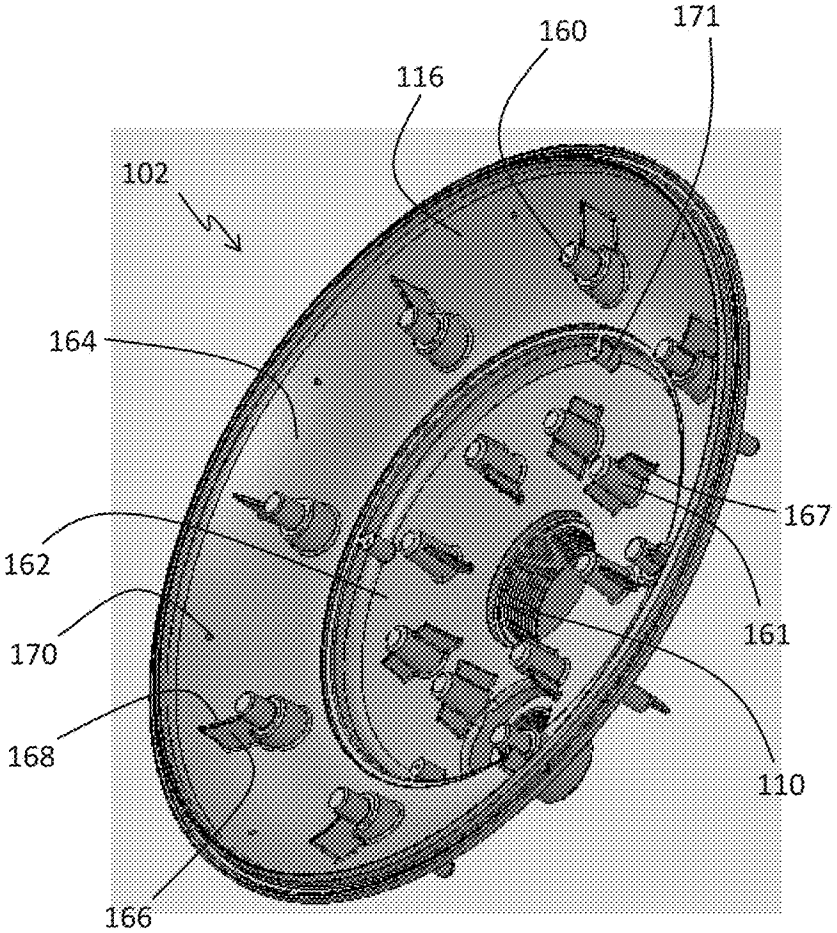
FIG. 5A is a partial front view of an embodiment of a sump base.

FIG. 5A shows an illustrative embodiment of the sump base 102. The sump base 102 can have a generally bowl-like shape. A central portion 162 of the top surface 116 of the sump base 102 can be recessed with respect to a peripheral portion 164 of the top surface 116 of the sump base 102, as illustrated in FIG. 5A. The sump base 102 can include one or more peripheral columns 160 that extend from the peripheral portion 164 of the top surface 116 of the sump base 102.

The peripheral column 160 can be tiered, with the top portion of the peripheral column 160 having a smaller cross-sectional area than the bottom portion of the column 160, as shown in FIG. 5A. The peripheral column 160 can be connected to one or more flanges 166 that extend from the peripheral column 160. The upper surface 168 of the flange 166 can be contoured to substantially match the bottom surface 122 of the sump cover 104, thereby allowing the flange 166 to reinforce the sump cover 104 and reduce deformation of the sump cover 104 toward the sump base 102. The peripheral columns 160 can circumferentially surround the outflow portion 110 of the sump base 102 with each peripheral column 160 being equally spaced from an adjacent peripheral column 160, as illustrated in FIG. 5A. In some variants, one or more peripheral columns 160 can be at a different radial distance from the outflow portion 110 than are other peripheral columns 160. The peripheral columns 160 may be unevenly spaced apart circumferentially around the outflow portion 110. The flanges 166 can be curved or angled and may be adapted to frustrate the formation of a vortex over the drain cover assembly 100, as described above with regard to the flanges 142 and spacers 144 of the sump cover 104.

The sump base 102 can include one or more central columns 161 that extend from the central portion 162 of the top surface 116 of the sump base 102. The central columns 161 can circumferentially surround the outflow portion 110 of the sump base 102 with each central column 161 being equally spaced from an adjacent central column 161, as illustrated in FIG. 5A. In some variants, one or more central columns 161 can be at a different radial distance from the outflow portion 110 than are other central columns 161. The central columns 161 may be unevenly spaced apart circumferentially around the outflow portion 110. The central column 161 can be connected to one or more flanges 167 that extend from the central column 161. The central column 161 and the flanges 167 can be configured to support the flow diffuser 114, as shown in FIGS. 5B and 7B. The flanges 167 can be curved or angled and may be adapted to frustrate the formation of a vortex over the drain cover assembly 100, as described above with regard to the flanges 142 and spacers 144 of the sump cover 104.

The sump base 102 can include one or more holes 170 that can align with the through holes 148 of the sump cover 104. The holes 170 can be threaded or otherwise configured to receive a fastener, thereby allowing the sump cover 104 to be attached to the sump base 102. The central portion 162 of the sump base 102 can include one or more anchors 171 for attaching the flow diffuser 114 to the sump base 102. For example, the anchor 171 can be a threaded sleeve that receives a screw (not shown) that passes through an anchoring hole 173 in the flow diffuser 114.

The peripheral columns 160 can be circumferentially aligned with the central columns 161, as shown in FIG. 5A. In other words, a radial line that extends from the center of the outflow portion 110 to the peripheral column 160 will pass through the central column 161 that is circumferentially aligned with the peripheral column 160. In the depicted embodiment, the flanges 166, 167 of the peripheral and central columns 160, 161 also align with the aforementioned radial line. This creates a series of chutes through which the water can flow toward the outflow portion 110. In the embodiment shown in FIG. 5A, the sump base 102 has eight chutes, with each of the holes 170 being located on a midline of a chute. The circumferential alignment of the peripheral and central columns 160, 161 can be selected to maximize the flow rate at which water can pass through the drain cover assembly 100.

Referring to FIG. 5B, the central columns 161 can be configured to support the flow diffuser 114, thereby maintaining the flow diffuser 114 spaced apart from the central portion 162 of the top surface 116 of the sump base 102. For example, in the illustrated embodiment the diffuser 114 has support openings 165 through which a portion of the central post 161 extends. The flow diffuser 114 can help prevent hair or other debris (e.g., swimsuit material) from entering the outflow portion 110 of the drain cover assembly 100. Due to the high suction forces of the drain cover assembly 100, a swimmer could become trapped and/or injured if the hair or swimsuit of the swimmer is sucked into the drain cover assembly 100. The flow diffuser 114 can distribute the suction force of the outflow portion 110 and limit the depth to which hair or clothing fiber can flow into the drain cover assembly 100. The flow diffuser 114 can be a flat, ring-like structure, as illustrated in FIG. 5B. The inner edge 172 of the flow diffuser 114 can be raised with respect to the outer portion 174 of the flow diffuser 114, thereby creating a raised lip that surrounds a central opening axially aligned with the outflow portion 110 of the sump base 102. The outer portion 174 of the flow diffuser 114 can have a plurality of small openings 176, giving the flow diffuser 114 a sieve-like appearance. The small openings 176 can help the flow diffuser 114 distribute the suction force of the outflow portion 110 to the periphery of the sump base 102. Hair and fibrous materials that enter the drain cover assembly 100 will be sucked against the small openings 176 of the diffuser 114 and will sit on top of the diffuser 114 without proceeding into the outflow portion 110. The suction forces at the small openings 176 of the diffuser 114 will be less than the suction forces within the outflow portion 110, thereby allowing a swimmer to extract hair or clothing fiber that enters the drain cover assembly 100.

Figure 6:
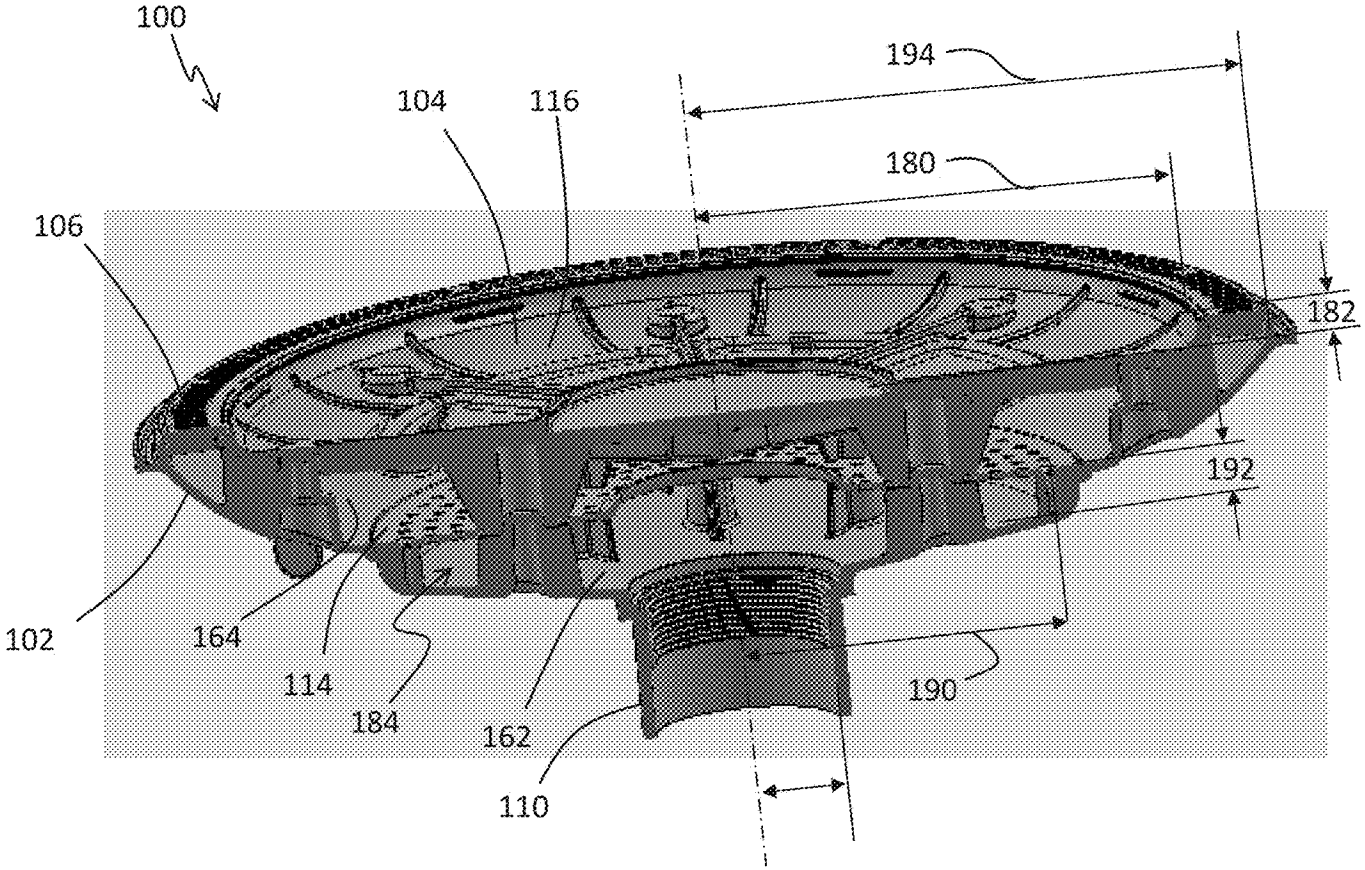
FIG. 6 is a cross-sectional side view of the embodiment of FIG. 1.

FIG. 6 shows a cross-sectional view of the drain cover assembly 100. The sump base 102 can have a rounded, tapered, and sloped shape that is adapted to fit over a drain pipe such as a three inch pipe. In some embodiments, the sidewall of the sump base 102 has a step configuration in which the lower section of the sump base has a substantially vertical side wall while the upper section has a sloped sidewall. The outflow portion 110 of the sump base 102 can couple the drain cover assembly 100 to the drain pipe (not shown). As discussed above, water can enter the drain cover assembly through the grate 106. The sump cover 104 can have a concave top surface 116 that is adapted to receive a facing material that helps the drain cover assembly 100 blend in aesthetically with the surrounding material into which the drain cover assembly 100 is mounted. Because the top surface 116 of the sump cover 104 is concave, the top surface 116 is more susceptible to deforming in the direction of the outflow portion 110 under the suction force of water passing through the drain assembly 100. Deformation of the sump cover 104 toward the outflow portion 110 can reduce the flow rate of water through the drain assembly 100 and compromise the integrity of the facing material that is attached to the top surface 116 of the sump cover 104. Accordingly, the drain cover assembly 100 includes features that reinforce the sump cover 104 while maintaining high flow rates through the drain assembly 100.

The concavity of the sump cover 104 can be selected so that the sump cover 104 provides enough depth to sufficiently accommodate the facing material while not overly impeding flow through the drain cover assembly 100. For a drain cover assembly 100 having a circular shape, the sump cover 104 can have a radius 180 and a depth 182. In the illustrated drain cover assembly 100, the ratio between the depth 182 and the radius 180 is about 0.05. In other embodiments, this ratio is at least about: 0.02, 0.04, 0.06, 0.08, 0.1, values between the aforementioned values, and otherwise. For a drain cover assembly 100 having a shape other than a circular shape (e.g., oval, polygonal), this ratio can be modified by substituting the value of one half of the outer dimension of the sump cover 104 for the radius 180.

As mentioned, the central portion 162 of the sump base 102 can be recessed relative to the peripheral portion 164 of the sump base 102, thereby creating a flow disbursement reservoir 184. The flow disbursement reservoir 184 can be disposed between the upper portion of the sump cover 102 and the outflow portion 110. The flow disbursement reservoir 184 can be configured to disburse the suction of the drain pipe over a wider area so that flow rate through the drain cover assembly 100 is increased. Advantageously, the design of the rounded and slope shaped sump base 102 and the extra flow disbursement reservoir 184 can significantly increase the flow rate of the drain cover assembly 100 to more than 300 gallons per minute, in some embodiments more than 380 gallons per minute.

The flow disbursement reservoir 184 can have a radius 190 and a depth 192. In the illustrated drain cover assembly 100, the ratio between the depth 192 and the radius 190 is about 0.2. In other embodiments, this ratio is at least about: 0.1, 0.3, 0.5, values between the aforementioned values, and otherwise. The upper portion of the sump base 102 can have a radius 194. In the illustrated drain cover assembly 100, the ratio between the radius 194 of the upper portion 164 of the sump base 102 and the radius 190 of the disbursement reservoir 184 is about 1.6. In other embodiments, this ratio is at least about: 1.2, 1.4, 1.8, 2.0, values between the aforementioned values, and otherwise.

Figure 7A:
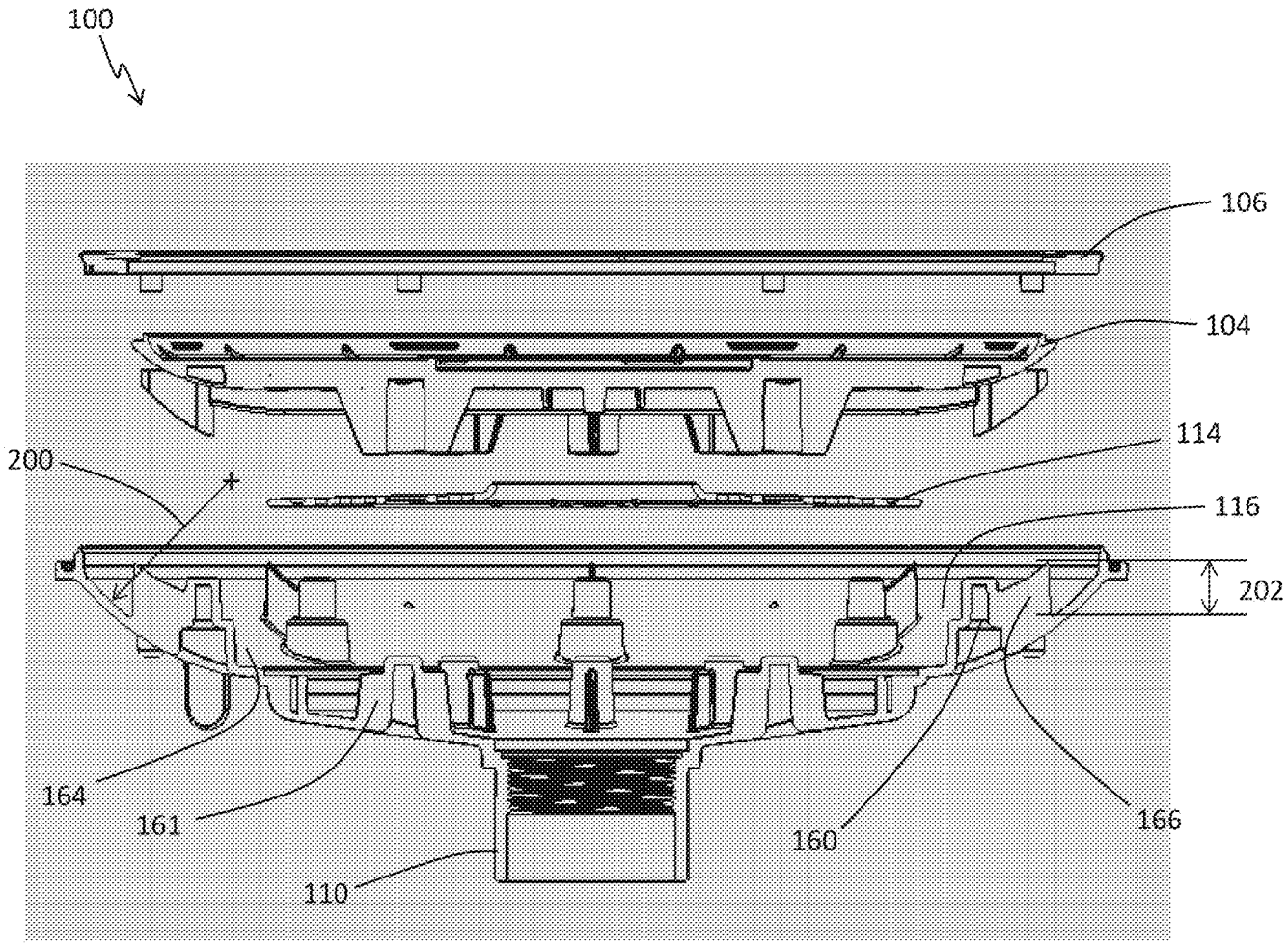
FIG. 7A is a cross-sectional, side, exploded view of an embodiment of the drain cover assembly.
Figure 7B:
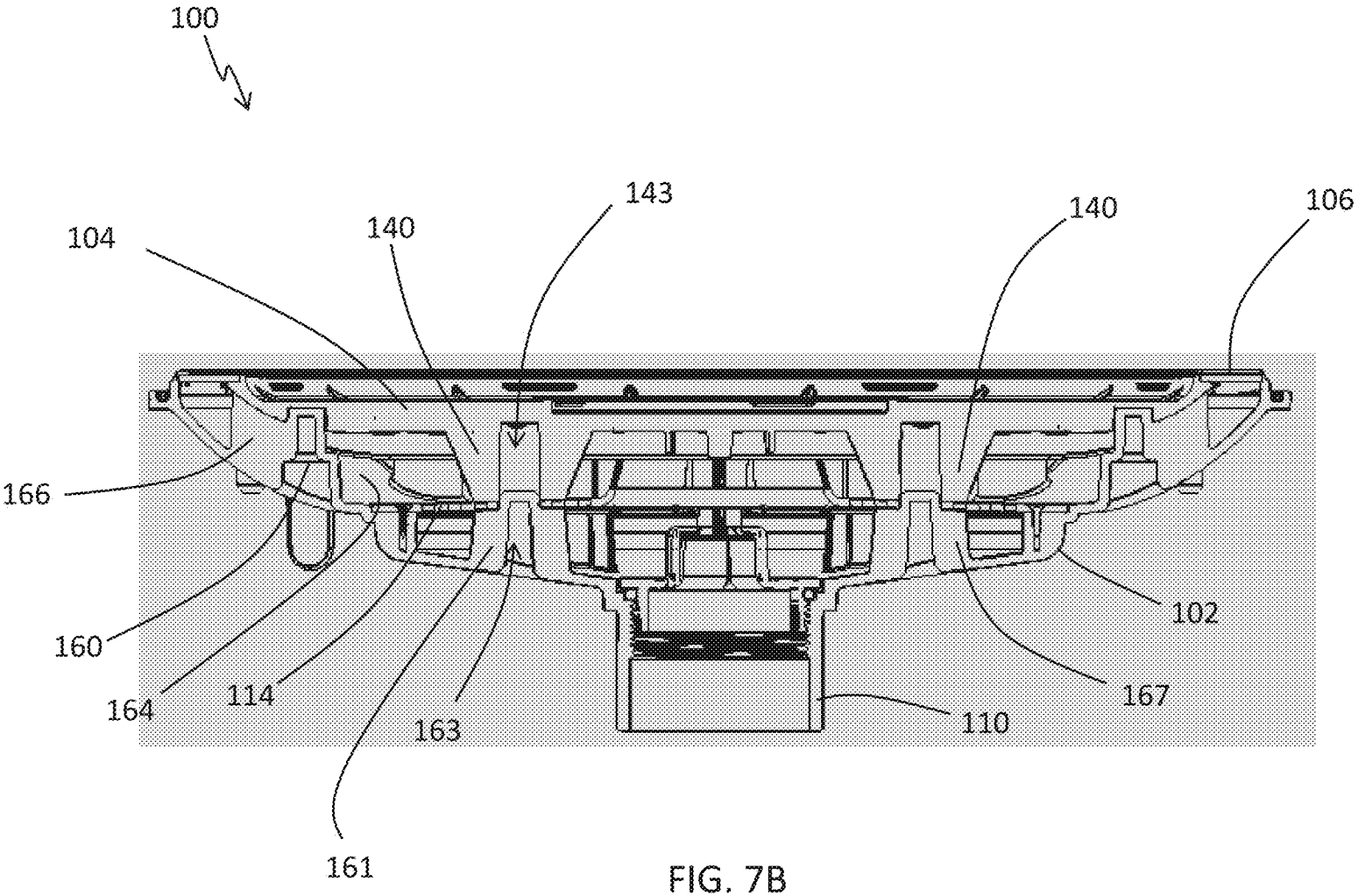
FIG. 7B is a cross-sectional, side view of the embodiment of FIG. 7A.

Referring to FIGS. 7A and 7B, the top surface 116 of the upper portion 164 of the sump base 102 can be rounded to smoothly transition the momentum of the water toward the outflow portion 110 of the drain cover assembly 100. The top surface 116 of the top portion 164 of the sump base 102 can be adapted to avoid introducing turbulence and/or high velocity gradients into the flow field of the water passing through the drain cover assembly 100, thereby keeping the frictional forces of the flow low and maintaining high flow rates through the drain cover assembly 100. In the illustrated embodiment, the top surface 116 of the upper portion of the sump cover 102 can have a radius of curvature 200. In some variants, the radius of curvature 200 of the top surface 116 can be constant as the top surface 116 extends between the grate 106 and the flow diffuser 114. In some variants, the radius of curvature 200 can increase as the top surface 116 extends between the grate 106 and the flow diffuser 114, as shown in FIG. 7A.

As mentioned above, the sump cover 104 can rest on the peripheral column 160 and the flange 166 that extends from the peripheral column 160 of the sump base 102, thereby creating a gap between the sump cover 104 and the sump base 102. This gap between the sump cover 104 and the sump base 102 can have a gap height defined by the height 202 of the flange 166. Referring to FIG. 7A, the height 202 of the flange 166 and the radius of curvature 200 can be selected so that a high rate of flow can pass through the drain cover assembly 100. In the illustrated drain cover assembly 100, the ratio between the height 202 and the radius of curvature 200 is about 0.3. In other embodiments, this ratio is at least about: 0.1, 0.2, 0.4, 0.6, values between the aforementioned values, and otherwise.

Referring to FIG. 7B, the drain cover assembly can include interlocking attachment features that facilitate assembly, installation, and removal of the drain cover assembly 100. The posts 140 of the sump cover 104 can align with the central columns 161 of the sump base 102, providing support for the support cover 104. The central columns 161 can surround a channel 163 that opens to the bottom surface of the sump base 102, as shown in FIG. 7B. The posts 140 can have a recess 143 that aligns with the channel 163. The drain cover assembly 100 can be assembled by inserting a fastener into the channel 163 from the bottom surface of the sump base 102 and advancing the fastener into the recess 143 of the sump cover 104. The fastener can be a threaded screw that mates with an internal thread on the recess 143, thereby allowing the fastener to secure the sump base 102 to the sump cover 104.

Figure 8A:
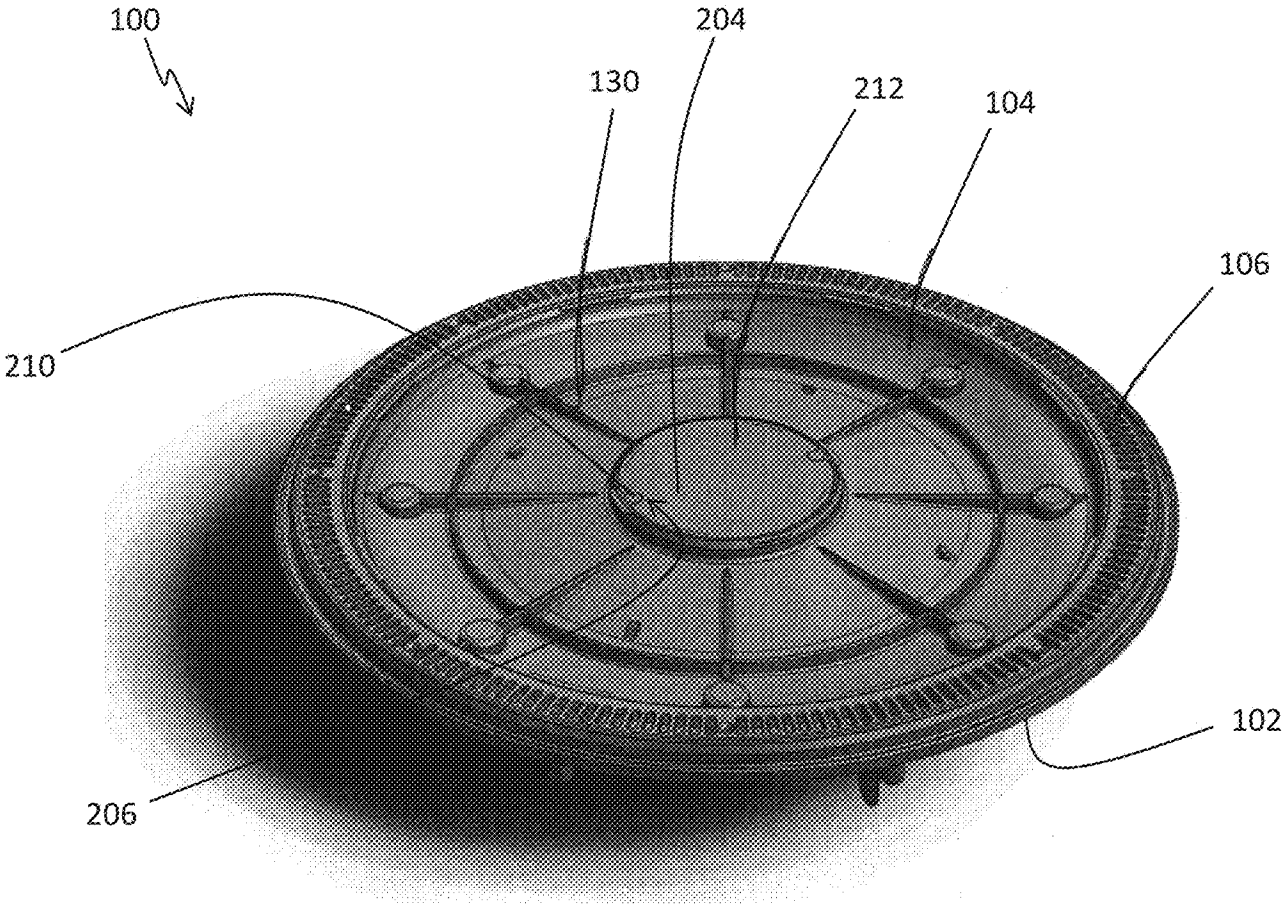
FIG. 8A is a perspective view of an embodiment of the drain cover assembly having a reversible insert.

Referring to FIGS. 8A and 8 B, the sump cover 104 can include a center insert 204 that can be reversible. The center insert 204 can be inserted into the center portion of the sump cover 104. The center insert 204 can have one or more recesses 206 that can receive and retain a tab 210 of the sump cover 104, thereby securing the center insert 204 to the sump cover 104. The center insert 204 can be inserted into the sump cover 104 in a first orientation, wherein a first surface 212 of the center insert 204 faces away from the sump base 102. The first surface 212 can include a plastic finish. The center insert 204 can be inserted into the sump cover 104 in a second orientation in which the first surface 212 faces toward the sump base 102. FIG. 8A shows the center insert 204 in the first orientation.

Figure 8B:
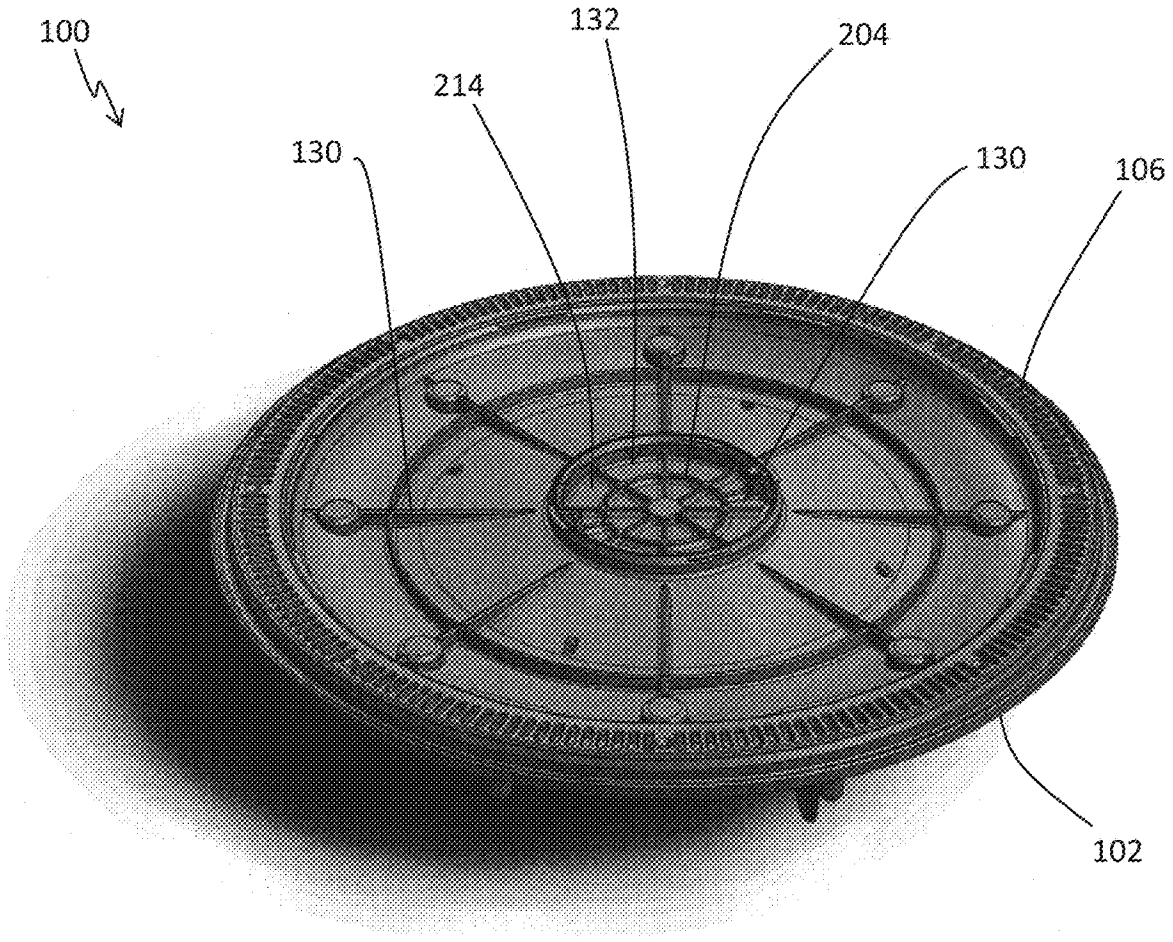
FIG. 8B is a perspective view of the embodiment of FIG. 8A with the reversible insert reversed.

FIG. 8B shows the center insert 204 in the second orientation. As shown in FIG. 8B, the center insert 204 can have a second surface 214 that has features for securing a facing material (e.g., plaster, aggregate) to the second surface 214. For example, the second surface 214 can include ribbing 130 and compartments 132, as described above with regard to the sump cover 104.

Figure 9:
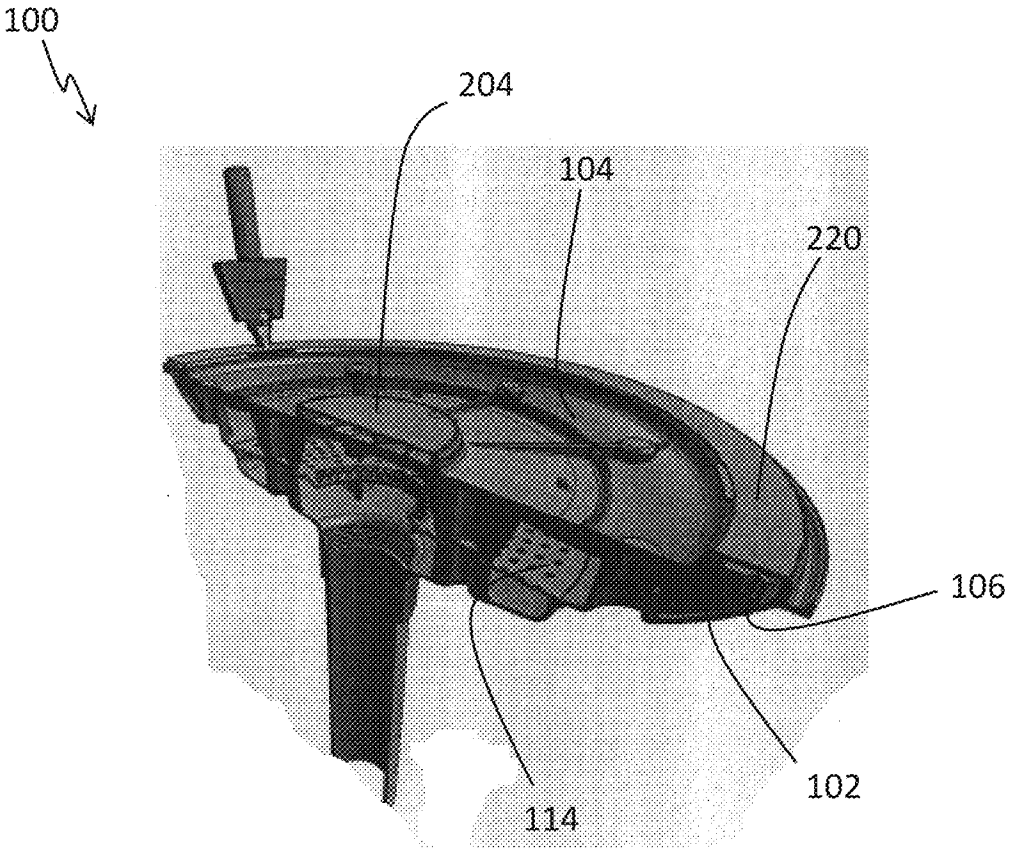
FIG. 9 is a cross-sectional perspective view of an embodiment of the drain cover assembly with a plaster ring.

Referring to FIG. 9, the drain cover assembly 100 can have a plaster ring 220 that is sized to fit over the grate 106. The plaster ring 220 can be applied to the drain cover assembly 100 before the facing material is added to the sump cover 104. The plaster ring 220 can cover the openings 107 of the grate 106 and prevent the openings 107 from becoming clogged by the plaster-like facing material when the plaster-like facing material is applied to the sump cover 104. After the plaster-like facing material has been applied to the sump cover 104, the plaster ring 220 can be removed from the drain cover assembly 100, thereby exposing the openings 107 of the grate 106 so that water can enter the drain cover assembly 100 through the openings 107 when the drain cover assembly 100 is installed.

Figure 10A:
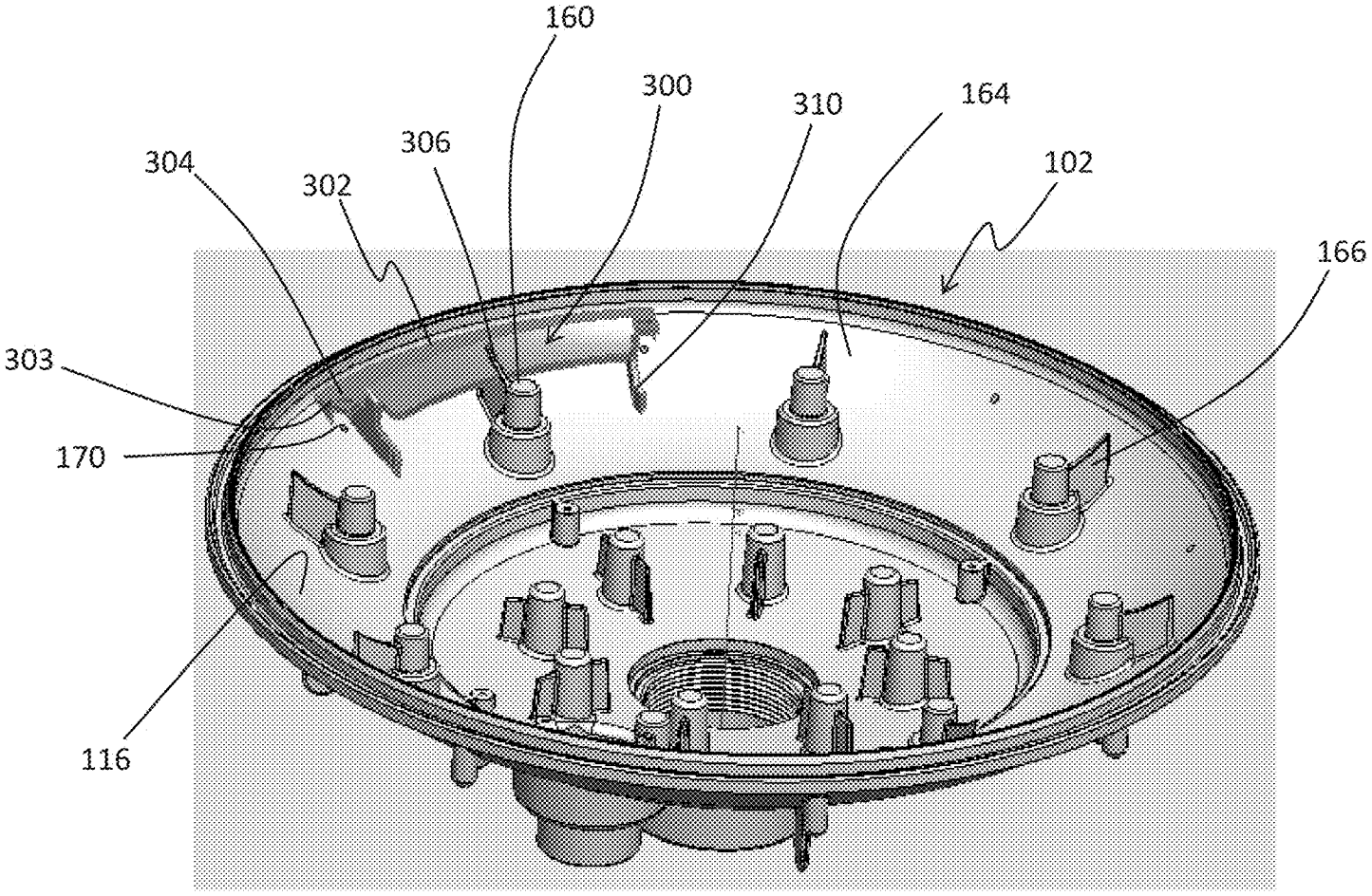
FIG. 10A is a perspective view of an embodiment of the drain cover assembly with a flow reducer.

Referring to FIG. 10A, the drain cover assembly 100 has an adjustable flow rate assembly designed to adjust the flow rate of the water as needed. The adjustable flow rate assembly can include one or more flow reducers 300 strategically placed around the drain opening. The flow reducer 300 can be positioned between the sump base 102 and the grate 106 (shown in FIG. 10C). A blocking surface 302 of the flow reducer 300 can be configured to block or reduce flow through the openings 107 of one or more sections of the grate 106, thereby reducing the flow through the drain cover assembly 100. In the some embodiments, the blocking surface 302 slopes away from the grate 106 as the blocking surface 302 extends radially outward. Water passing through the portion of the grate 106 that covers the flow reducer 300 can slide down the blocking surface 302 and fall over an edge 303 of the blocking surface 302 to reach the top surface 116 of the peripheral portion 164 of the sump base 102. In some embodiments, the blocking surface 302 can be flush with the grate 106 so that no flow can pass through the portion of the grate 106 that covers the flow reducer 300.

The flow reducer 300 can include features for mounting the flow reducer 300 to the drain cover assembly 100. For example, in the illustrated embodiment, the flow reducer includes a through hole 304 that can align with the hole 170 in the sump base 102 that is used for attaching the grate 106 to the sump base 102. In some variants, the flow reducer 300 can have a recess that fits over the flange 166 of the peripheral column 160. As shown in FIG. 10A, the flow reducer 300 can be configured to reduce flow through only a portion of the grate 106. The flow reducer 300 can have a base 310 that rests on the top surface 116 of the peripheral portion 164 of the sump base 102. The illustrated flow reducer 300 would block about one-eighth of the circumference of the grate 106. The flow reducer 300 can be adjusted to block more or less flow through the drain cover assembly 100 by attaching multiple flow reducers 300 and/or attaching a flow reducer 300 that extends around a greater or a lesser portion of the grate 106.

Figure 10B:
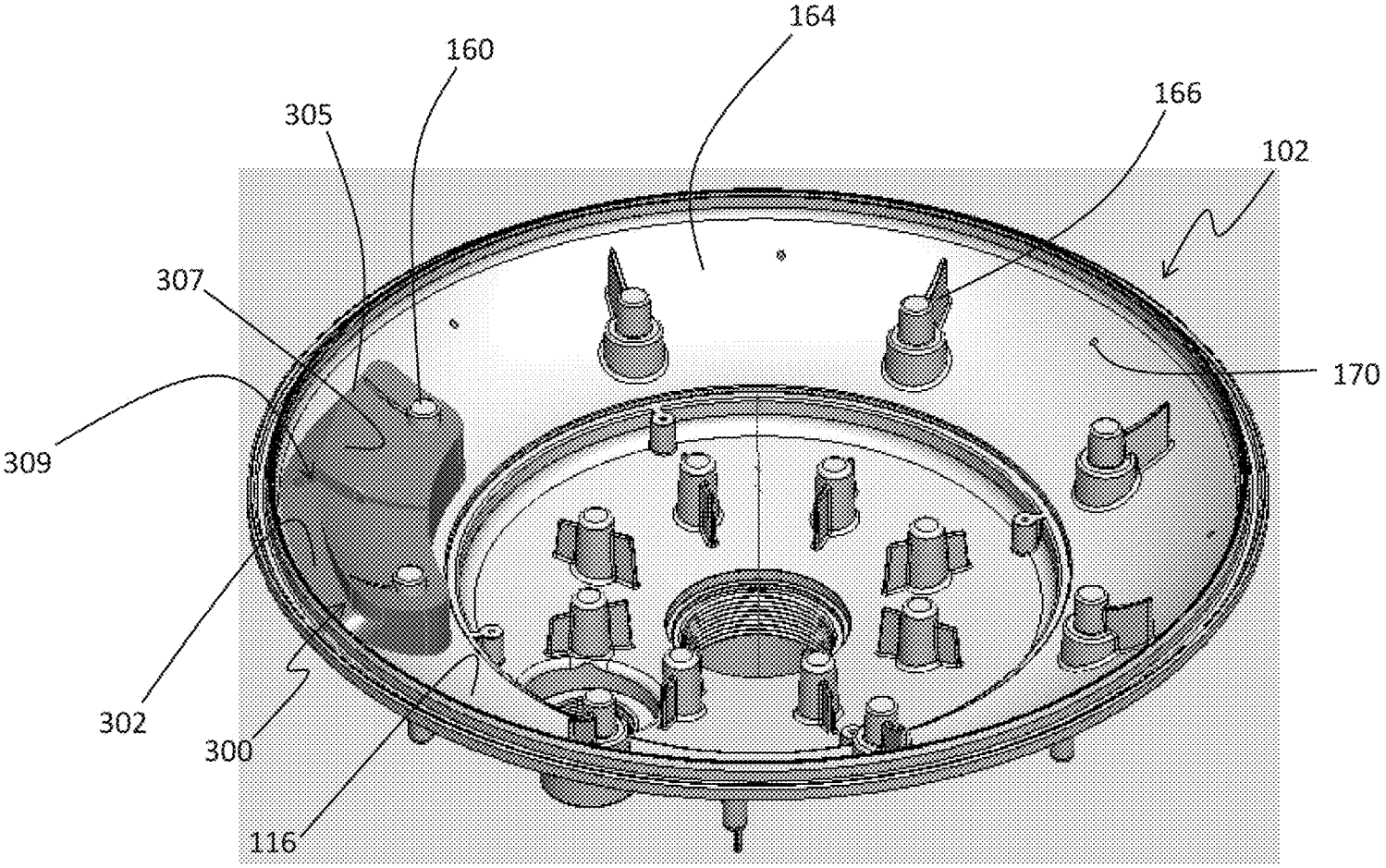
FIG. 10B is a perspective view of an embodiment of the drain cover assembly with a flow reducer.

FIG. 10B illustrates another embodiment of the flow reducer 300. As shown in FIG. 10B, the blocking surface 302 of the flow reducer 300 can be sloped to direct the flow toward the top surface 116 of the peripheral portion 164 of the sump base 102. The flow reducer 300 can include a ridge 305 that extends to a portion of the grate 106 that is radially inward of the openings 107 of the grate, thereby preventing water from flowing across the inner surface 307 of the flow reducer 300. The flow reducer 300 can include a slot 309 that allows a fastener to access the hole 170 in the top surface 116 of the peripheral portion 164 of the sump base 102.

Figure 10C:
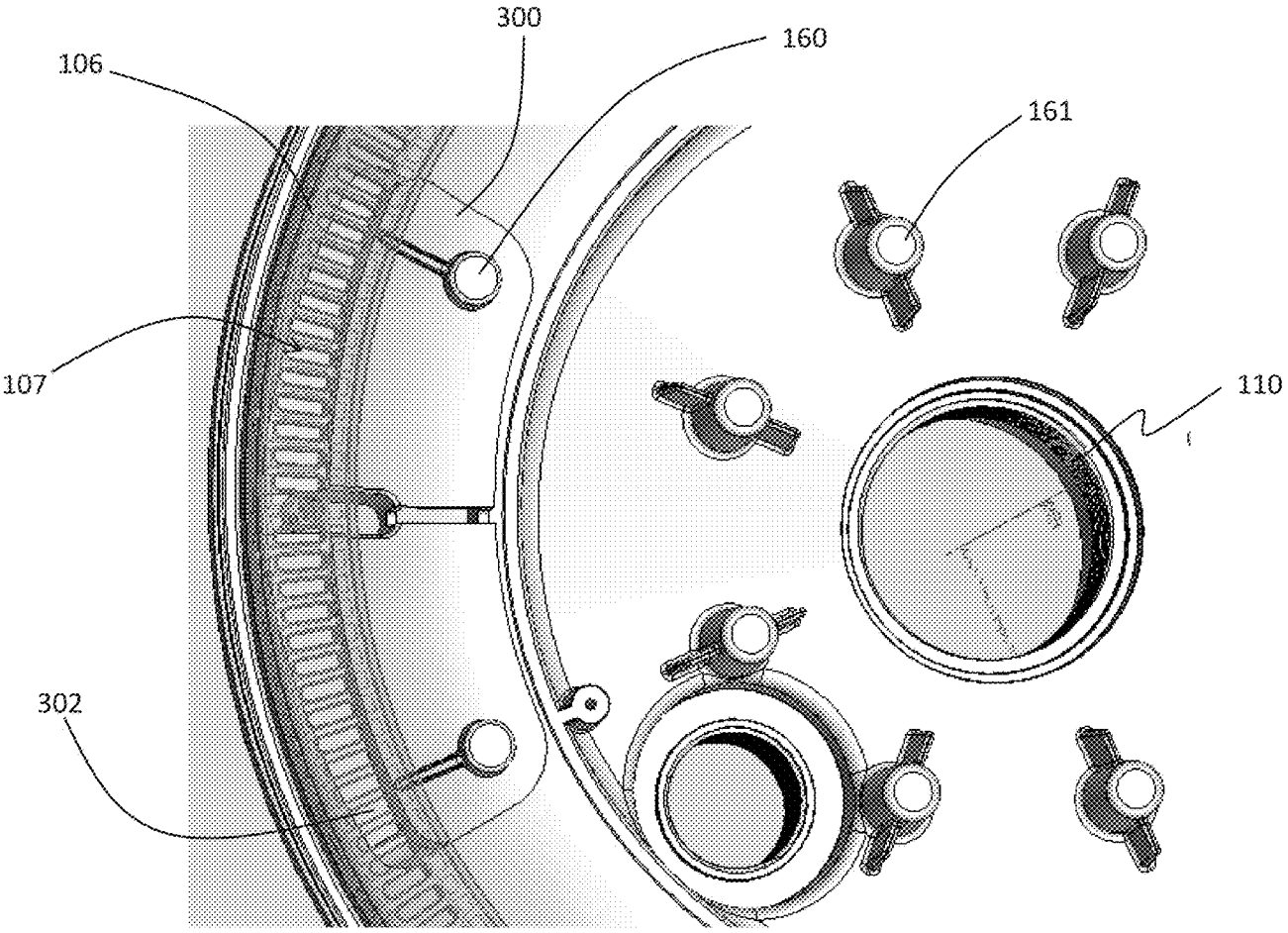
FIG. 10C is a partial top view of an embodiment of the drain cover assembly with a flow reducer.

Referring to FIG. 10C, the grate 106 can be configured to radially overlap with at least a portion of the flow reducer 300. As seen in the illustrated embodiment, the openings 107 of the grate 106 can cover the blocking surface 302 of the flow reducer 300.

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. An interchangeable high flow drain cover assembly, comprising:

a sump base having a substantially circular sidewall defining an upper opening and a lower opening, said sump base having an upper sump base portion and a lower sump base portion, said lower sump portion comprises a flow disbursement reservoir, wherein the sidewall of the upper sump base portion is sloped to facilitate water flow, wherein the sidewall of the flow disbursement reservoir has a reduced slope as compared to the slope of the upper sump base portion;

a sump cover, said sump cover having a concave configuration sized to fit over the sump base and nest inside the upper opening of the sump base;

an annular opening disposed between the sump base and sump cover, said annular opening configured to allow water to flow therethrough to the sump base and out the lower opening of the sump;

wherein an upper surface of the sump cover is concave and configured to seat a plaster-like surface finishing material in a manner such that an upper surface of the plaster-like surface finishing material is flush with the annular opening; and wherein the upper surface of the sump cover comprises a plurality of ribbing that provides bonding surfaces for the finishing material.

2. The drain cover assembly of claim 1 further comprising an annular grate, said annular grate configured to be positioned over the annular opening and couple with the sump base.

3. The drain cover assembly of claim 2, wherein said annular grate reversibly couples to the sump base thereby allowing the drain cover assembly to be used interchangeably as a grated or open flow system.

4. The drain cover assembly of claim 1 further comprising a flow diffuser, said flow diffuser comprises a plurality of openings formed thereon, said flow diffuser is positioned between the sump cover and the sump base, and adapted to reduce the suction created by the drain.

5. The drain cover assembly of claim 1, wherein the upper surface of the sump cover comprises a lip that curves radially inward.

6. The drain cover assembly of claim 1, wherein the sump cover comprises a post that extends from a back surface of the sump cover.

7. The drain cover assembly of claim 6, wherein the post comprises a flange that extends from a side surface of the post.

8. The drain cover assembly of claim 1, wherein the sump base comprises a column that extends from the sidewall of the sump base.

9. The drain cover assembly of claim 8, wherein the sump cover comprises a counter-sink configured to receive the column that extends from the sidewall of the sump base.

10. The drain cover assembly of claim 8, wherein the column provides support to the sump cover.

11. The drain cover assembly of claim 1, wherein the sump cover has a radius and a depth, wherein a ratio of the depth to the radius is about 0.05.

12. The drain cover assembly of claim 1, wherein the upper surface of the sump cover is configured to seat a plaster-like surface finishing material selected from the group consisting of: plaster, aggregate, tile, plastic, and epoxy.

13. The drain cover assembly of claim 1, wherein the plurality of ribbing comprises one or more hook-like protrusions.

14. The drain cover assembly of claim 1, wherein at least one of the plurality of ribbing has a form of an "I" beam.

15. An interchangeable high flow drain cover assembly, comprising:

a sump base having a substantially circular sidewall defining an upper opening and a lower opening, said sump base having an upper sump base portion and a lower sump base portion, said lower sump portion comprises a flow disbursement reservoir, wherein the sidewall of the upper sump base portion is sloped to facilitate water flow, wherein the sidewall of the flow disbursement reservoir has a reduced slope as compared to the slope of the upper sump base portion;

a sump cover, said sump cover having a concave configuration sized to fit over the sump base and nest inside the upper opening of the sump base;

an annular opening disposed between the sump base and sump cover, said annular opening configured to allow water to flow therethrough to the sump base and out the lower opening of the sump;

an adjustable suction member comprising a radius and adapted to be positioned along a section of the annular opening; and wherein an upper surface of the sump cover is concave and configured to seat a plaster-like surface finishing material in a manner such that an upper surface of the plaster-like surface finishing material is flush with the annular opening.

16. The drain cover assembly of claim 15, wherein the adjustable suction member comprises a base that rests on the sidewall of the sump base.

17. The drain cover assembly of claim 15 further comprising an annular grate, said annular grate configured to be positioned over the annular opening and couple with the sump base.

18. The drain cover assembly of claim 17, wherein said annular grate reversibly couples to the sump base thereby allowing the drain cover assembly to be used interchangeably as a grated or open flow system.

19. The drain cover assembly of claim 15 further comprising a flow diffuser, said flow diffuser comprises a plurality of openings formed thereon, said flow diffuser is positioned between the sump cover and the sump base, and adapted to reduce the suction created by the drain.

20. The drain cover assembly of claim 15, wherein the sump cover comprises a post that extends from a back surface of the sump cover.

21. The drain cover assembly of claim 20, wherein the post comprises a flange that extends from a side surface of the post.

22. The drain cover assembly of claim 15, wherein the sump base comprises a column that extends from the sidewall of the sump base.

23. The drain cover assembly of claim 22, wherein the sump cover comprises a counter-sink configured to receive the column that extends from the sidewall of the sump base.

24. The drain cover assembly of claim 15, wherein the sump cover has a radius and a depth, wherein a ratio of the depth to the radius is about 0.05.

* * * * *